US008132814B1

(12) United States Patent
Ganti

(10) Patent No.: US 8,132,814 B1
(45) Date of Patent: Mar. 13, 2012

(54) SUDOKU SOLVING APPARATUS

(76) Inventor: Sastry Ganti, Buffalo Grove, IL (US)

( * ) Notice: Subject to any disclaimer, the term of this patent is extended or adjusted under 35 U.S.C. 154(b) by 6 days.

(21) Appl. No.: 12/931,551

(22) Filed: Feb. 7, 2011

(51) Int. Cl.
*A63F 9/08* (2006.01)
*A63F 9/24* (2006.01)

(52) U.S. Cl. ..... 273/272; 273/237; 273/238; 273/281; 273/282.1; 273/284; 273/288; 273/148 R; 273/153 R

(58) Field of Classification Search ..... 273/148 R, 273/237, 238, 282.1, 288, 272, 287, 281, 273/291, 284, 153 R
See application file for complete search history.

(56) References Cited

U.S. PATENT DOCUMENTS

| | | | | |
|---|---|---|---|---|
| 7,677,564 | B2 | 3/2010 | Kriger | |
| 2007/0105077 | A1* | 5/2007 | Pechter | 434/188 |
| 2007/0145681 | A1* | 6/2007 | Terbush et al. | 273/148 R |
| 2007/0210516 | A1 | 9/2007 | Bohac | |
| 2008/0161106 | A1* | 7/2008 | Morris | 463/31 |
| 2010/0171264 | A1* | 7/2010 | Zarumba | 273/236 |

* cited by examiner

*Primary Examiner* — Benjamin Layno

(57) ABSTRACT

An apparatus to solve Sudoku puzzles, wherein each one of the 81 single-squares has nine sub-area squares, each having one of the 1 through 9 digits, with all digits set to 'at-display' at start, and by selectively setting to 'no-display' 8 digits at each one of the initially given number's single-square location of a given puzzle so as to set up the puzzle, followed by logically setting other digits to 'no-display' at other single-squares needing solutions, the process of 'no-display' setting can be continued until all the single-squares have for each one only one digit 'at-display' as per Sudoku rules.

2 Claims, 11 Drawing Sheets

SUDOKU SOLVING APPARATUS

CROSS-REFERENCE TO RELATED APPLICATION

Not applicable

FEDERALLY SPONSORED RESEARCH

Not applicable

SEQUENCE LISTING OR PROGRAM

Not Applicable

BACKGROUND OF THE INVENTION

1. Field of Invention

This invention relates to solving a Sudoku puzzle of any difficulty level;

- by quickly setting up in place 'given-numbers' of a puzzle on the apparatus;
- by quickly setting up all solution possibilities at all 'single-squares' at once;
- by helping to quickly find the single-digit solutions at single-squares;
- by helping to retract any errors made and retrace without a fresh start-over;
- by helping to clearly identify always the 'given-numbers' apart from the 'arrived-numbers' (i.e. the only possible single-digit solution numbers);
- by helping to solve the entire puzzle without need of any writing and erasing aids;
- by allowing repeated usage of the apparatus for new puzzles;
- by helping to solve difficult puzzles faster and yet not diminish the challenges of logical thinking required;
- By helping to instill courage to solve very difficult puzzles till the end.

Sudoku is a popular puzzle, with a set of a few 'given-numbers' at start that are assigned specific locations to 'single-squares' which are set up as a 9×9 pattern of 81 single-squares. The single-squares are grouped further, with the outer boundaries of each group being visually distinct, as clusters of nine (3×3=9) single-squares forming total of 9 square 'regions'. Only single-digits chosen from 1 through 9 can occupy any single-square, whether given or arrived number. The object is to solve the puzzle by finding single-digit numbers for all the empty squares, while observing the rule that no row, no column, and no 'region' within it has a repeated digit.

Having been supplied a set of 'given-numbers', their quantity, positioning, and values determine the level of difficulty of solving a given puzzle.

2. Prior Art

Prior art for Sudoku puzzle solving utilizes methods that have disadvantages.

Disadvantages of Prior Art:

1 It presents the puzzle solver blank squares requiring writing in;

2 It most often requires writing aids, raising possibility for errors;

3 It most often requires erasing and writing aids, to correct errors;

4 When an error is discovered, backtracking is difficult and messy;

5 The apparatus often is for one use only and then it is discarded;

6 Any reusable apparatus is tarnished with frequent writing and erasing;

7 Frequent erasing and correcting taxes the thinking process required, and may instill discouragement with partially solved puzzles left behind;

8 An electronic apparatus may tend to have helping logic software which may negate the challenge of logical thinking that is to be encouraged;

9 Error making being a normal frequent human experience, difficult puzzles become daunting and discouraging;

10 Difficult puzzles are very often left not attempted robbing one of mental and visual exercises and the discipline of logical thinking.

3. Objects and Advantages

Present invention utilizes a Sudoku solving apparatus accommodating the 81 single-squares for the 'arrived-numbers' plus the 'given-numbers'.

However in the present invention, each single-square contains 9 subareas, with each single-square containing all the single-digits from 1 through 9, one digit per subarea with no repetition of digits, and with means for digits being at-display or at no-display for every digit individually.

Hence present invention requires no writing aids.

Present invention requires no erasing aids.

At start in each single-square designated as a location for a 'given-number' its 8 non-matching digits can be set to 'no-display' leaving only the matching digit at at-display.

For any particular single-square needing an 'arrived-number' solution, that square's non solution digits can be set to no-display through logic by the means provided, and as more digits are identified to be not the solutions those digits can be set at no-display. The process continues until every single-square has 8 digits at no-display.

At any time each 'arrived-number' can be back tracked and checked for its accuracy as a solution. In case of errors discovered, the no-display status of any required digits can be changed to at-display and the logic process reapplied.

As the puzzle solving continues, It is possible to simply leave any only remaining digit at-display in its single-square to remain so, and proceed solving for the other single-squares. But, since a single-digit occupies only $1/9^{th}$ of a single-square and may appear inconveniently small, a separate larger full single-square size 'number-pad' may be snap-installed as an overlay at a single-square. This prominently visible number-pad, meant to occupy a single-square, can mask all the 9 digits of a single-square, whether they be at-display or at no-display. This snap-installation can be even used at start for the 'given-numbers' also.

It is suggested that the two types of number-pads ('arrived' versus 'given') appear different from each other in some significant way, so as to recognize them by their differences while puzzle solving is in progress. This recognizing shape difference between number-pads can be interchanged without any change in functionality.

In case of an electronic/electrical board, the statuses of at-display and no-display of digits will equivalently be 'switch on and switch off' statuses.

For an electronic display pad, it could be just a matter of resizing to a larger size the text size of each of the only digit that is to occupy a given single-square and adjust the text format as a means of differentiating between the two types, namely given versus arrived.

For an electrical display pad (or for that matter, for an electronic one also) the snap-installation of larger overlay number-pads can also be used.

DRAWINGS, FIGURES

Note, Emb. is Equivalent to Embodiment

FIG. 1 Sudoku solving apparatus, partially set up, emb. #1

FIG. 2 Close-up view of Sudoku solving apparatus, emb. #1

FIG. 3 Top close-up view of Sudoku solving apparatus, emb. #1

FIG. 4 Typical single 'region' with 9 single-squares, emb. #1

FIG. 5 Typical single-square with 1-9 single-digits, each with a hole, emb. #1

FIG. 6 Typical 'given-number' overlay number-pad, emb. #1

FIG. 7 Typical digit-cover as an overlay over a subarea single-digit, emb. #1

FIG. 8 Typical 'arrived-number' overlay number-pad, emb. #1

FIG. 9 A representative single-square for electrical Sudoku board, emb. #2

FIG. 10 Underside view of single-square for electrical Sudoku board, emb. #2

FIG. 11 Overall view of 'window frame' style Sudoku board, emb. #3

FIG. 12 Right lower corner region of 'window-frame' style Sudoku board, emb. #3

FIG. 13 Typ. 3 axle-wires & flippable digits for a row of 9 single-squares, emb. #3

FIG. 14 Sudoku 'window-frame' style puzzle in the progress of solving, emb. #3

FIG. 15 Typical 'arrived-number' as single-square overlay number-pad, emb. #3

FIG. 16 Typical 'given-number' as single-square overlay number-pad, emb. #3

FIG. 17 Typical hat to distinguish given versus arrived-at number-pads, emb #3

FIG. 18 Two digit-tablets on an axle-wire showing the flipping action, emb. #3

FIG. 19 'Window-frame' style Sudoku board with round digit-tablets, emb #3

FIG. 20 'Axle-wire' on which three round digit-tablets are at 'no-display', emb #3

DRAWINGS, REFERENCE NUMERALS

10 Typical single-digit marked on a subarea on a Sudoku apparatus, emb. #1

12 Typical digit-cover placed on a single-digit marking, emb. #1

14 Typical 'given-number' overlay number-pad on a single-square, emb. #1

16 Typical 'arrived-number' overlay number-pad on a single-square, emb. #1

18 Typical hole at each digit to locate/overlay a digit-cover, or other, emb. #1

20 Insertion/handling post of a 'given-number' overlay number-pad, emb. #1

22 Insertion/handling post of a digit-cover, emb. #1

24 Insertion/handling post of a 'arrived-number' overlay number-pad, emb. #1

26 Typical opaque frame of a single-square for electrical board, emb. #2

28 Engraved or etched single-digit that lets light through, emb. #2

30 Lamp (light source) under a digit to set a single-digit to at-display it, emb. #2

32 Window pane style Sudoku frame of regions and single-squares, emb #3

34 A flappable, pivoting digit-tablet on a axle-wire, emb. #3

36 Typical axle-wire, emb. #3

38 Horizontal frame member's distinctive demarcation of a region, emb. #3

40 Vertical frame member's distinctive demarcation of a region, emb. #3

42 Hat on a single-square overlay number-pad, at 'given-number', emb. #3

44 Handling post on a single-square overlay (arrived) number-pad, emb. #3

46 Partially solved single-square with two possible digits as solution, emb. #3

48 A fully solved single-square showing an 'arrived-number', emb. #3

50 A flipped digit-tablet rotated almost by 180 deg. to no-display status, emb. #3

DETAILED DESCRIPTION

General Comments Common to all Embodiments

Present invention utilizes a suitable means to display (FIG. 1, 11, 14, 19, etc.) with 81 single-squares for the functional area of the Sudoku puzzle. The main functional apparatus for the puzzle may be made of flat materials such as wood, paper, plastic or light sheet metal or any other suitable substantially flat material. It may be designed to be permanently open or it may be foldable to become compact and portable. If the display is electronic/electrical, its appearance and construction may mimic any of the numerous apparatuses available with displays, such as notepads, intelligent phones, LED display panels, etc.

In all the embodiments described every one of the 81 squares is provided 9 equal subareas with all the digits 1 through 9, set to at-display at the start of a new puzzle.

The invention is described in three embodiments, namely:

1. A plain Sudoku display board having means to permanently show digits (FIGS. 1, 2, 3, 4, 5).
2. An electrical or electronic Sudoku display board (FIGS. 9 & 10).
3. A Sudoku 'window style' frame board wherein digits are flippable individual tablets with pivot axes substantially through center. The digits in any particular linear row (or column) are mounted through their pivot axles through the center on a common axle-wire that is embedded into the frame (FIGS. 11, 12, 13, 14, 18, 19, 20).

The preferred embodiment is the last mentioned embodiment, number 3.

In all cases each digit occupies a subarea about $1/9^{th}$ of a single-square. There are 81×9=729 digits in all on the puzzle's display board.

When a particular puzzle is to be solved, first its 'given-numbers' may be displayed in their given fixed location single-squares on the puzzle's board in one of two ways as follows.

Eight non matching digits in each single-square location of the 'given-number' may be set to no-display, so that only the matching digit representing the 'given-number' remain set to at-display; or, a single-square size overlay number-pad (having same number as the given-number of that single-square) may be snapped in place at each of the particular single-squares. Each of these number-pads will mask all the 9 digits of the single-square under it.

Similarly during puzzle solving a single-square size overlay number-pad, having same number as the arrived-number of that single-square, may be snapped in place at each of the particular single-squares. Each one of these number-pads will also mask all the 9 digits of the single-square under it.

In each embodiment the means of being at-display and at no-display may be different and are described in the embodiments.

Embodiment #1

Detailed Description (FIG. 1, 2, 3, 4, 5, 6, 7, 8)

Present invention utilizes a suitable flat board permanently marked digits.

The individual first places on the assigned single-squares, all the 'given-numbers" overlay number-pads (#14 and FIG. 6) of a given puzzle, or sets to no-display 8 particular digits at each of the mentioned single-squares, using digit-covers (FIG. 7 and #12), so that only the digits matching given-numbers are at-display status, He-She then continues to place as logic and instinct directs, digit-covers (#12, and FIG. 7) using handling/positioning posts (#22) at any single-square location's digits (#10) at holes (#18), to eliminate the non-solutions at that single-square. Digit-covers may be shaped circular as shown, or be shaped square, rectangle,
oval, or 'L', etc. to mask one or multiple digits simultaneously.

He-she may opt to do this on all digits of the board for a Sudoku puzzle which is designated as 'very difficult' and does not give a solution quickly, or do partially to look for quick initial answers in an easy puzzle.

If it does appear that on a given single-square 8 digit-covers can be placed, then the $9^{th}$ digit being the solution or 'arrived-number',—if preferred, all the 8 digit-covers on that single-square can be removed and appropriate 'arrived-number' overlay number-pad (#16 and FIG. 8) can be placed there.

Based on the solution now arrived at, other digit-covers may be placed masking more digits to locate more solutions.

This logical process can be continued to solve the entire puzzle of any difficulty with no writing and erasing.

FIGS. 2 & 3 show a close-up view of partially set up Sudoku solving logic board.

FIG. 4 shows a single-region containing 9 single-squares, As shown in FIG. 5, each single-square contains all the 1 through 9 digits (#10), each with an digit-cover or number placement hole (#18). The centrally located hole at digit #5 will be used to place a 'given-number' overlay number-pad (#14, and FIG. 6), or to place an 'arrived-number' (#16 and FIG. 8) overlay number-pad.

All the overlay placement items have on both sides for insertion or handling, posts as shown (#s 20, 22 & 24, FIGS. 6, 7, 8).

Embodiment #2

Detailed Description (FIGS. 9 and 10)

This is for an electrical or electronic display board for solving Sudoku.

FIGS. 9 and 10 show an electrical board's single-square (#26) with lamps (say, LED type, #30). The board's material is primarily opaque so that one compartment's lamp does not affect the others. The digit markings (#28) are such that light can penetrate them, thus displaying a digit when the lamp underneath is on.

This invention does not encourage any manner of puzzle solving helping aids in the form of software logic to be included with the display apparatus. What is needed is the means of turning on or off the digit display individually, and means to distinguish 'given-numbers' against 'arrived-numbers' on the display, say by changing the size or color of digits.

Electronic display may mimic the display of a laptop, i-phone, etc.

Embodiment #3

Detailed Description (FIGS. 11, 12, 13, 14, 15, 16, 17, 18, 19, 20)

Referring to FIG. 11 (#32), the window-like frame work is divided into distinct 3×3 regions and each region is further subdivided into 3×3 single-squares. Each single-square holds nine flippable digit-tablets (#34) by the pivoting support of axle-wires (#36) through holes in the digit-tablets. The pivot connections are designed with light friction so that a digit-tablet holds its set position without freely rocking.

By flipping any particular digit 180 deg. about its axle-wire's axis, the digit effectively sets itself to no-display by carrying its digit marking to the opposite side (FIG. 18, #50 and FIGS. 19 and 20).

The wire-axles are shown carrying a series of digits horizontally. Alternately, the wire-axles can be arranged to be vertical with no loss in functionality.

As mentioned before in embodiment #1, if the size of a digit is too small for viewing the displayed solution number for a single-square (FIG. 14, #48), then an overlay number-pad (FIG. 14 #s 42 & 44, FIG. 15, 16) can be snap installed. In FIG. 14, (#46) shows where 7 digit-tablets have been flipped reducing the puzzle solving to two possible digits at this single-square.

FIGS. 15 and 16 depict one way of differentiating 'arrived-numbers' from 'given-numbers'.

Figure 1:
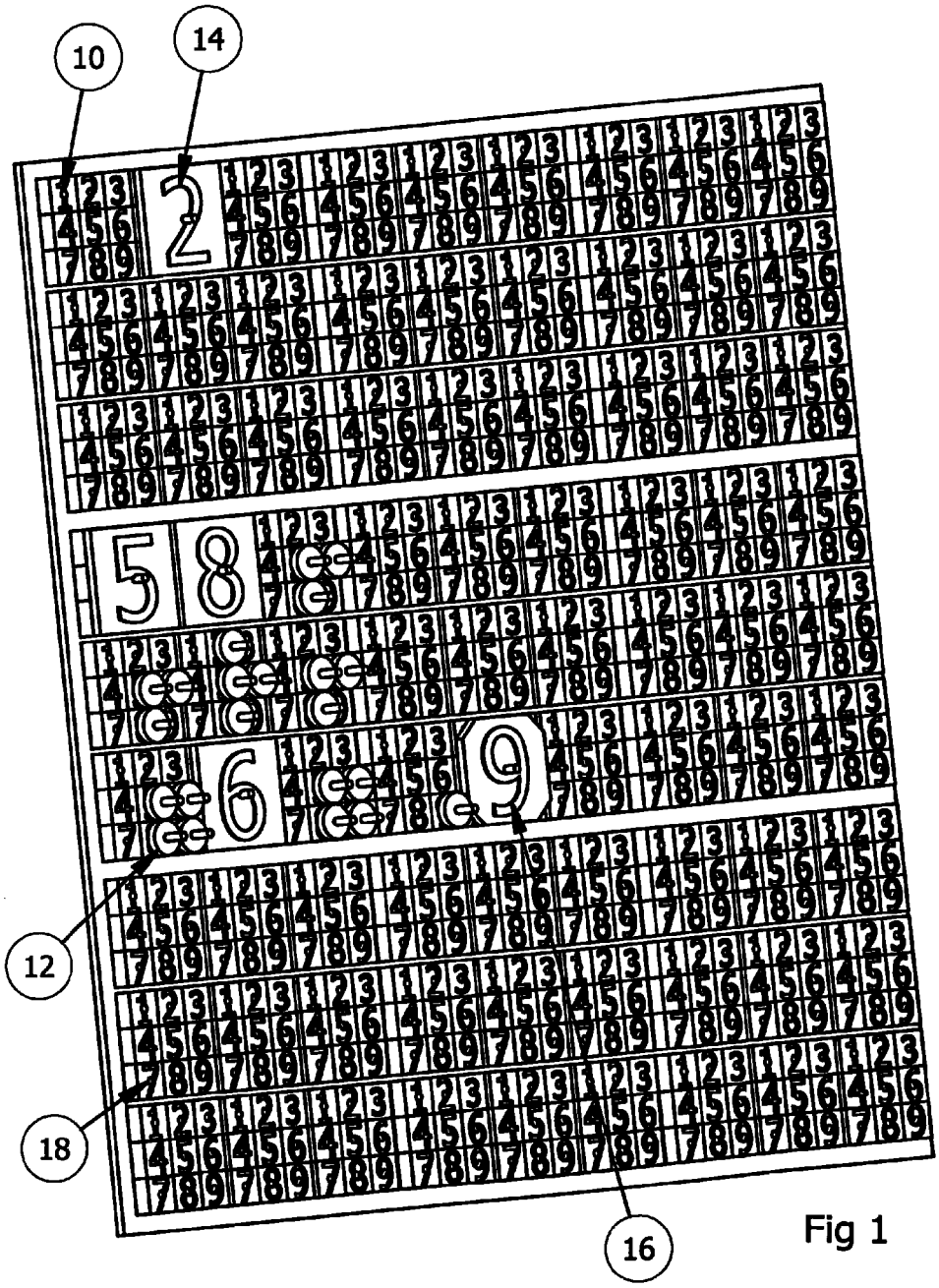
Figure 2:
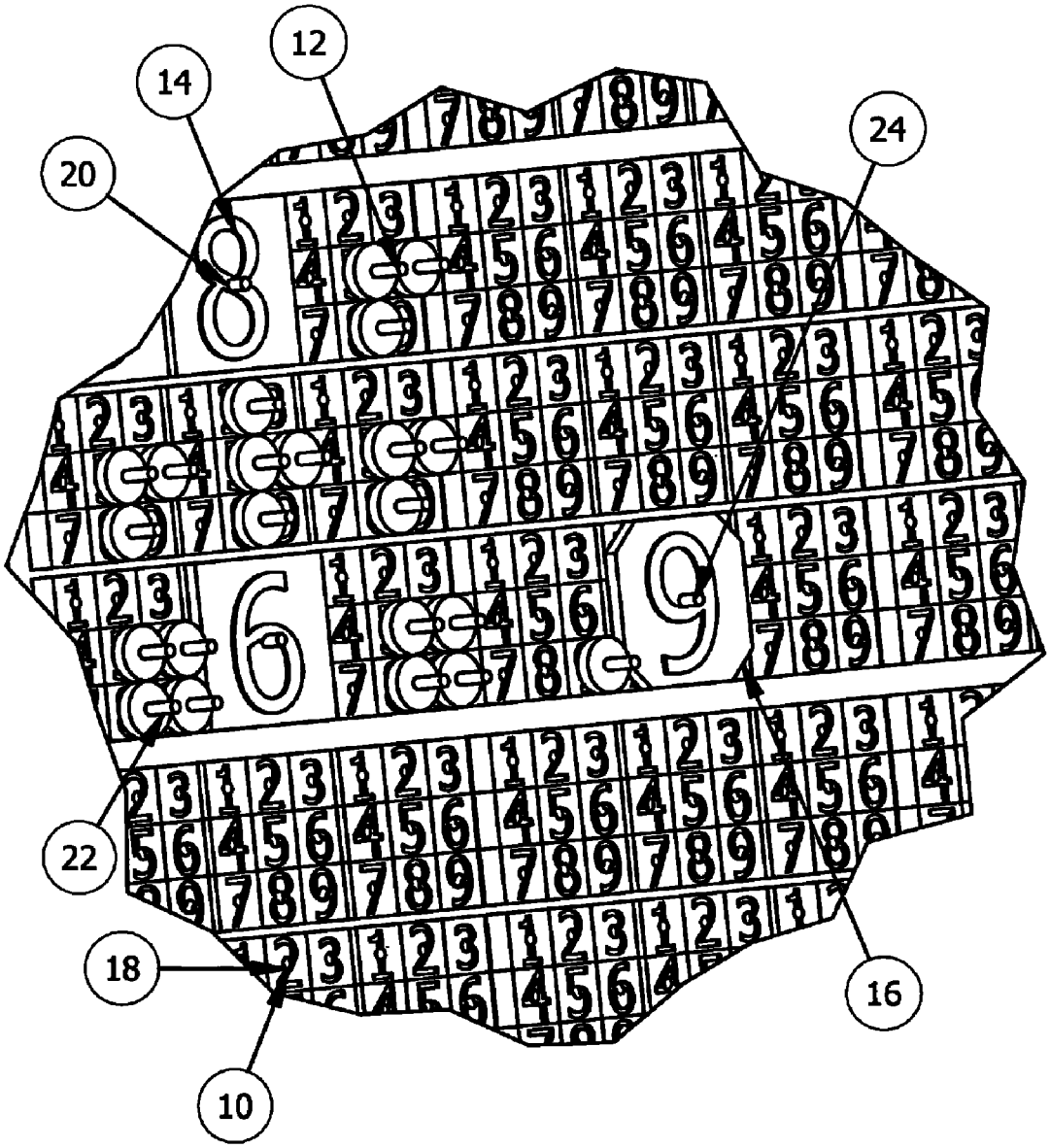
Figure 3:
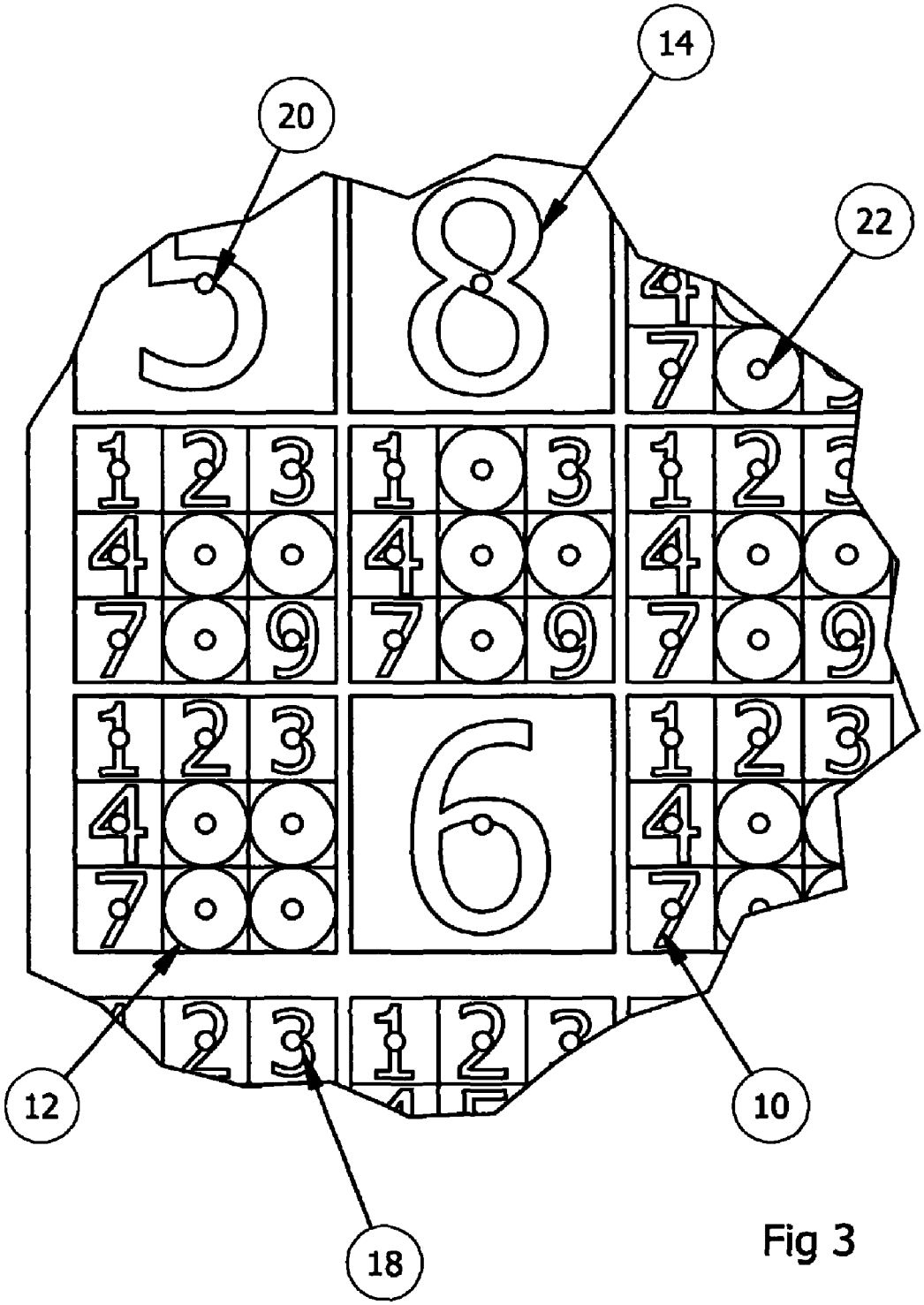
Figure 4:
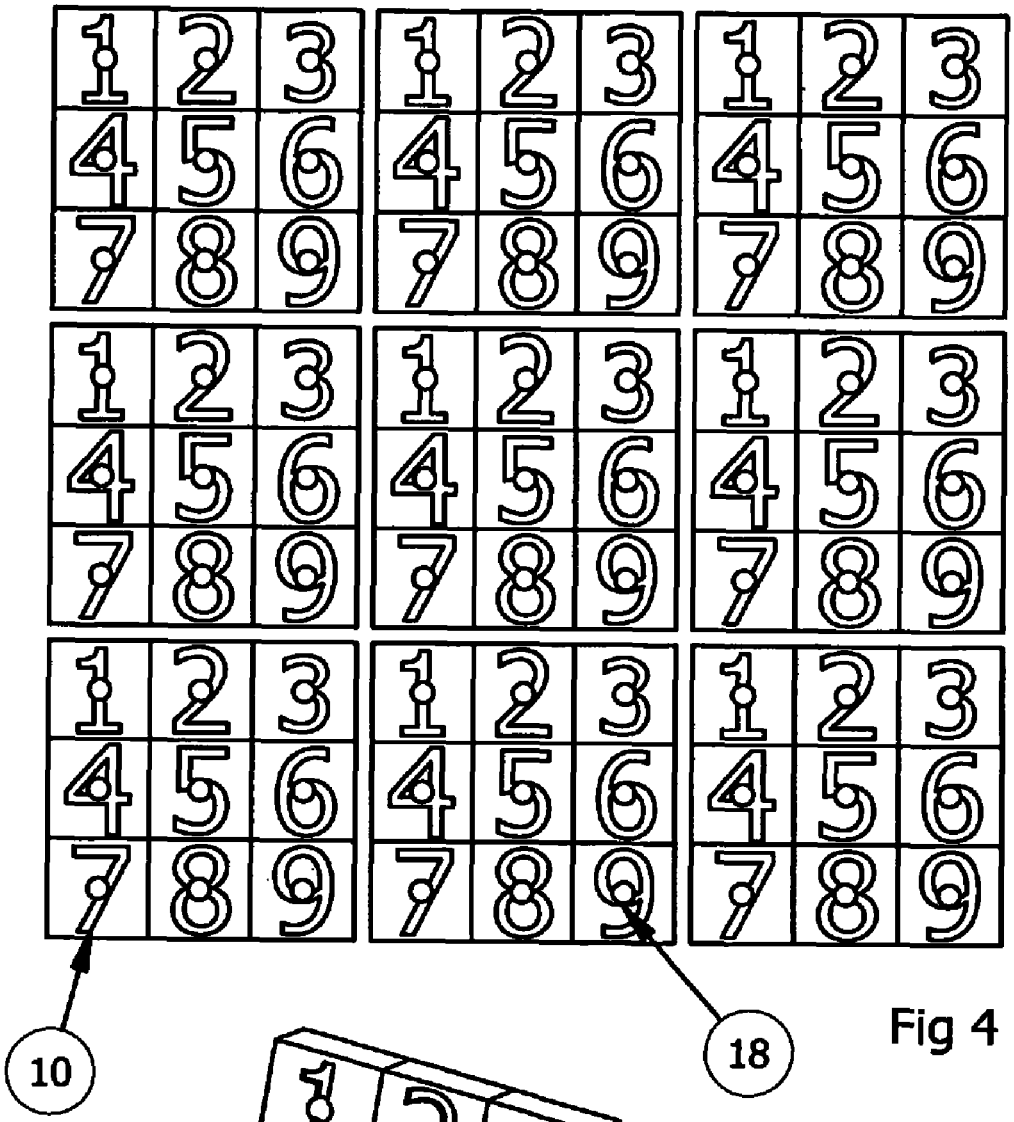
Figure 5:
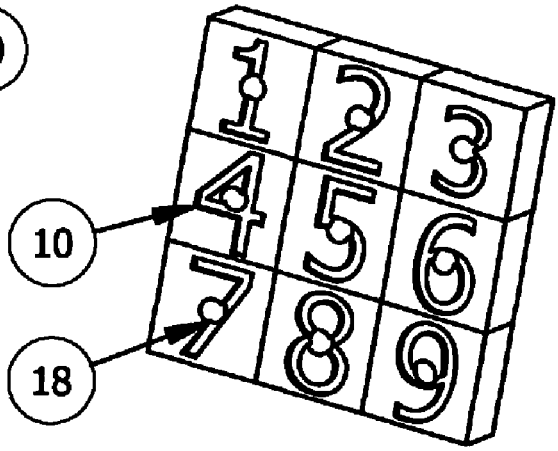
Figure 6:
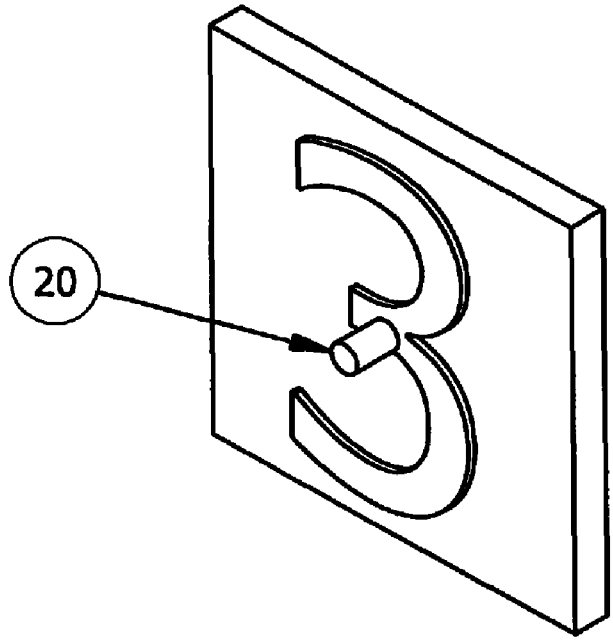
Figure 7:
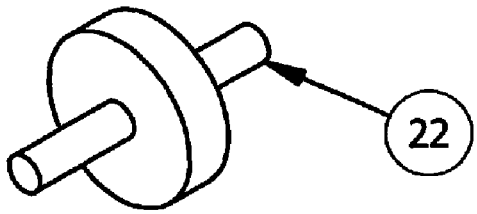
Figure 8:
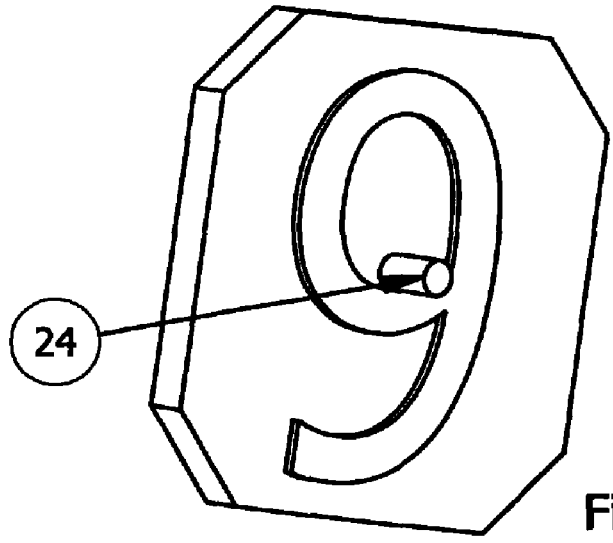
Figure 9:
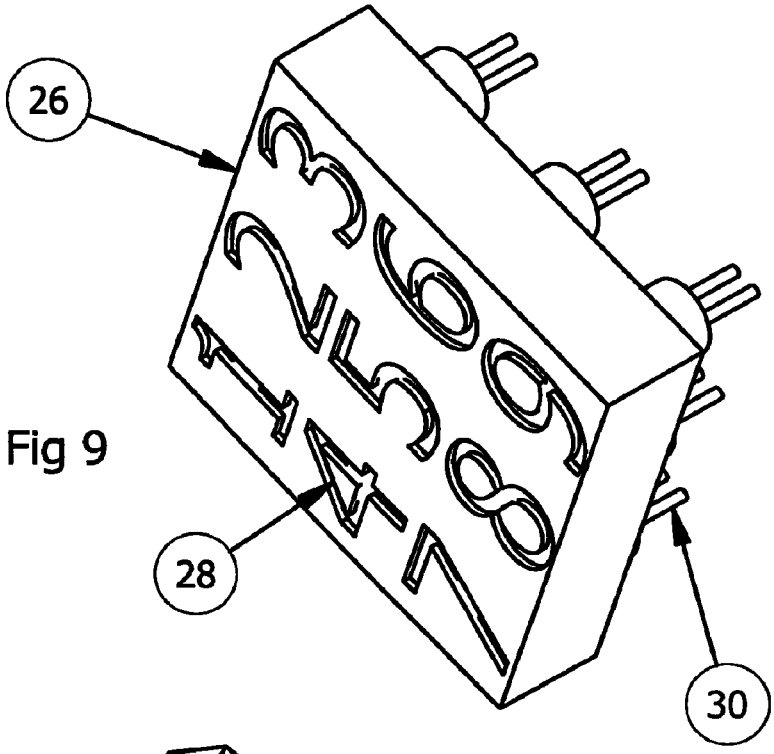
Figure 10:
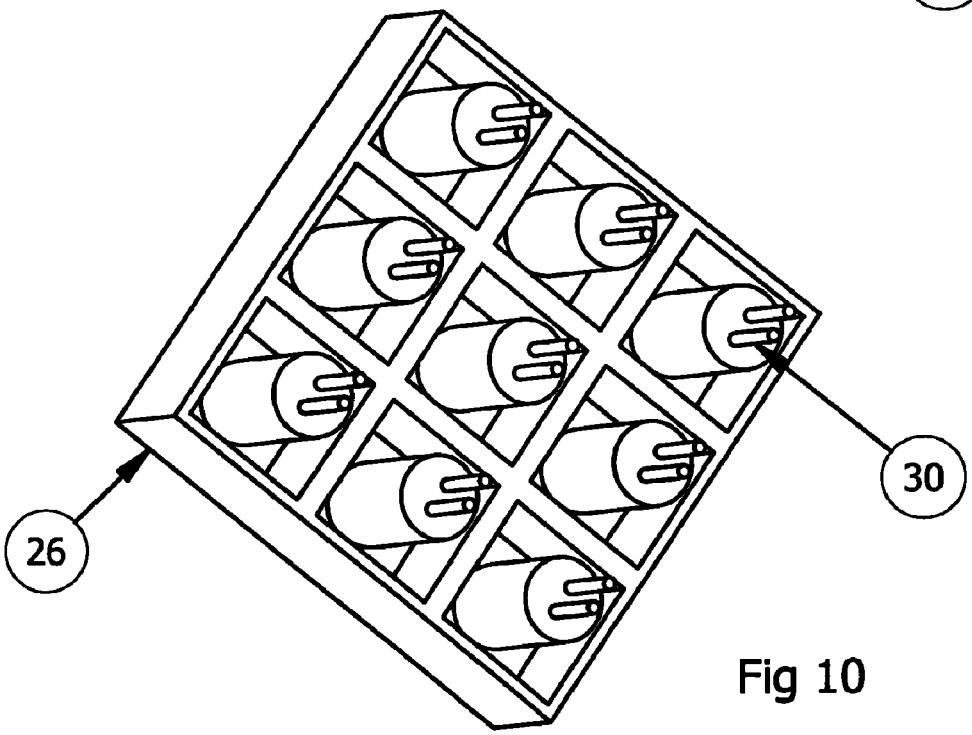
Figure 11:
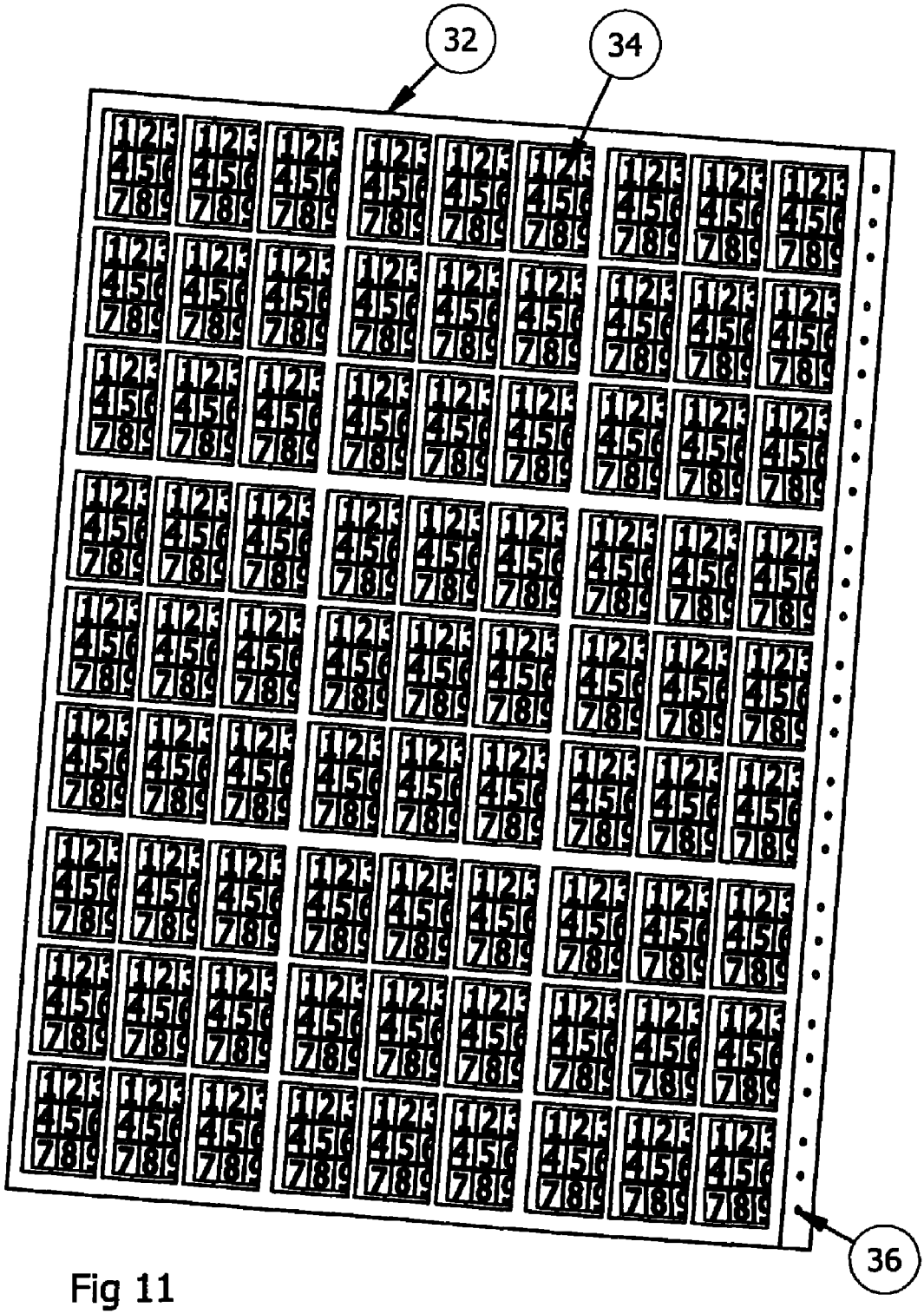
Figure 12:
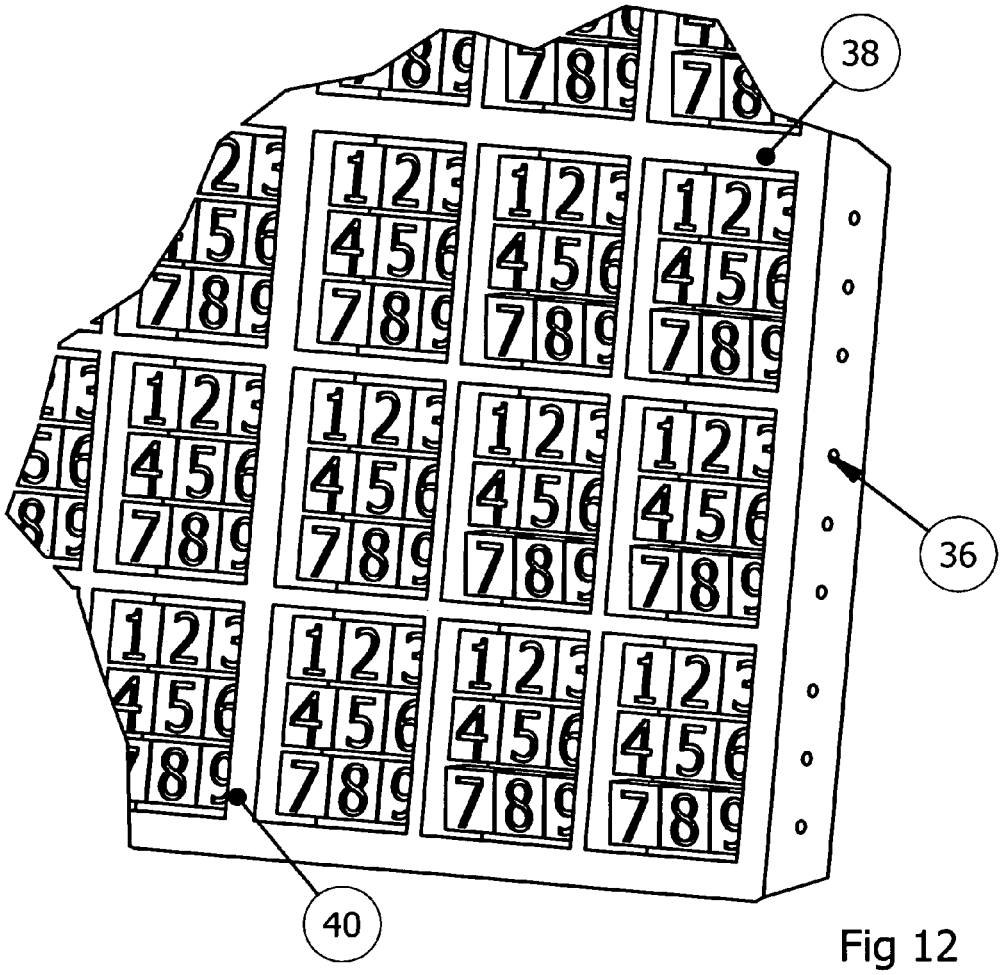
FIG. 12 shows the lower right region of 3×3 single-squares, where (#s 38 & 40) of the frame represent the distinguishing inner boundaries of the region.
Figure 13:
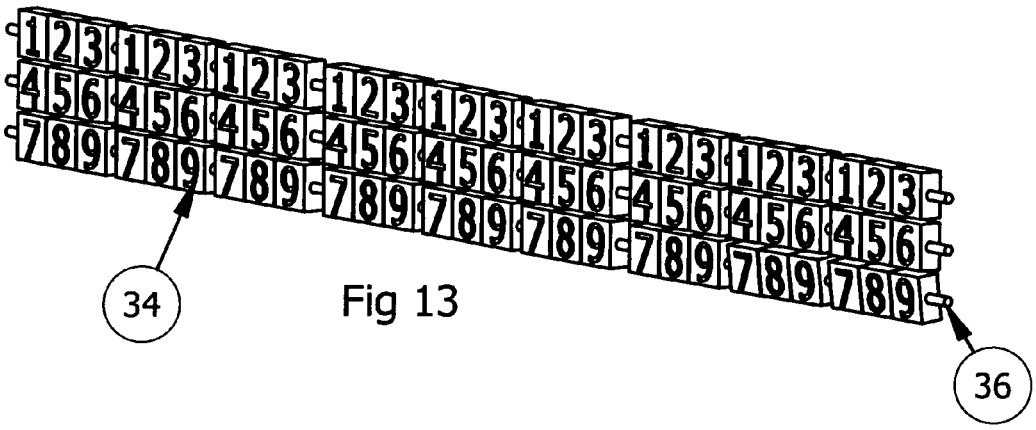
FIG. 13 shows a row of 9 single-squares with their digit-tablets on axle-wires and the support frame being not present.
Figure 14:
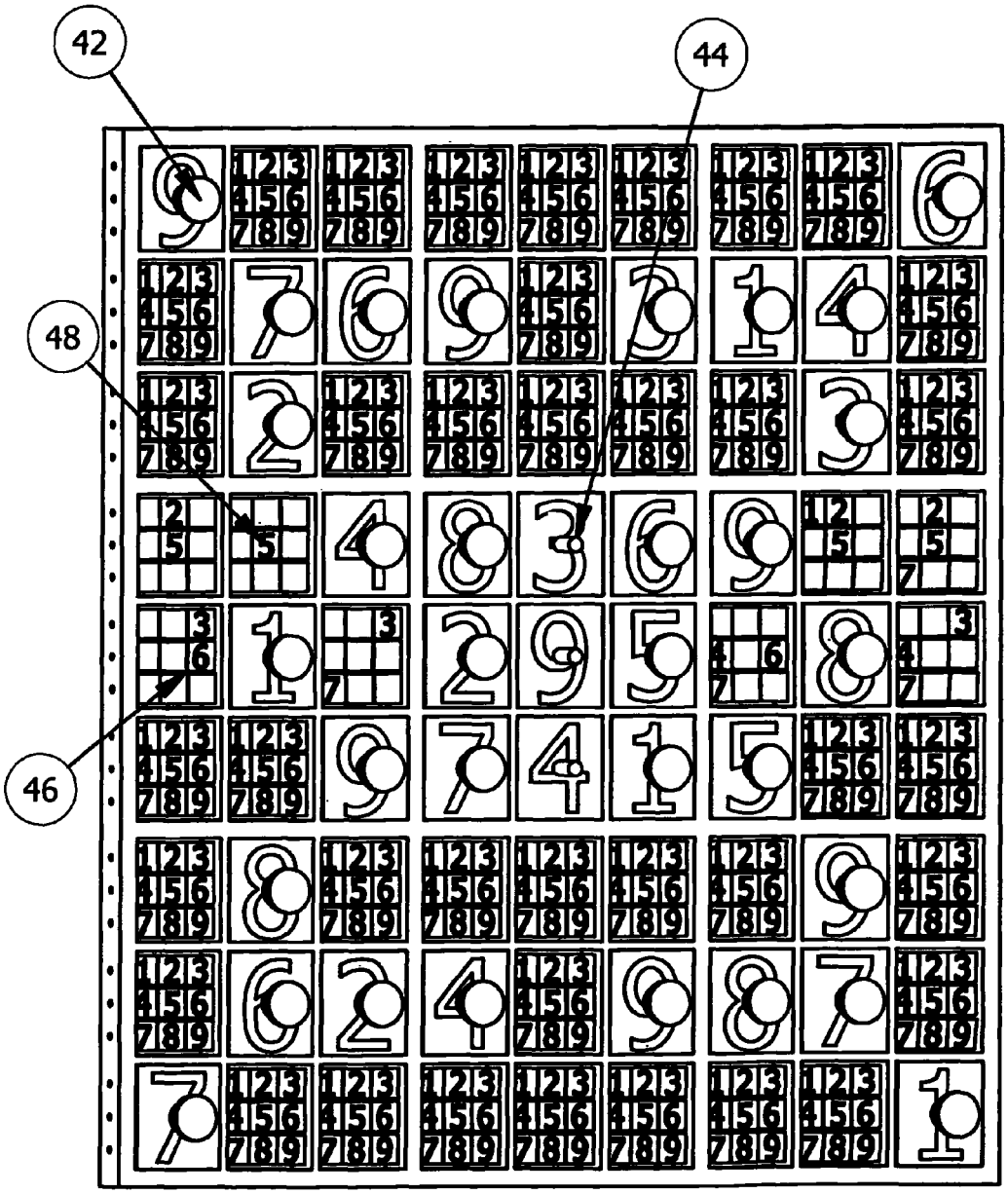
Figure 15:
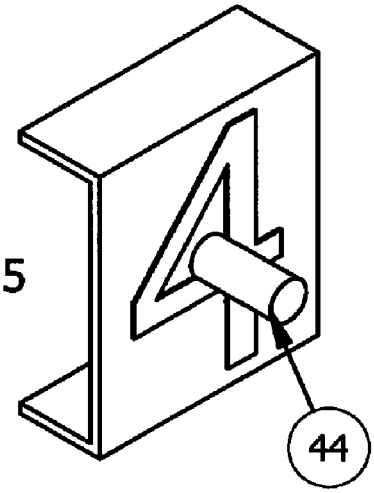
FIG. 15 shows an overlay number-pad. (#44) is a handling post on the pad.
Figure 16:
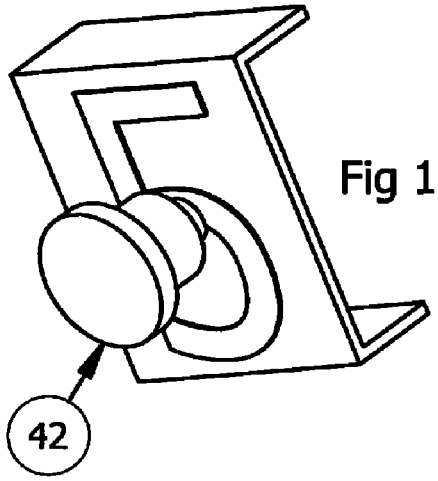
FIG. 16 shows a different overlay number-pad, with hat (#42) (see FIG. 17) mounted over the pad's post.
Figure 17:
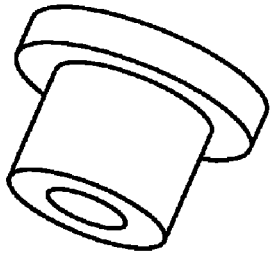
Figure 18:
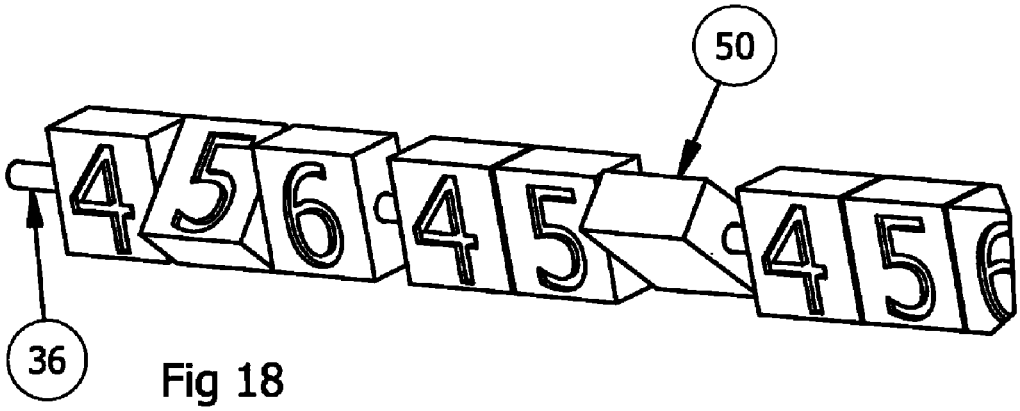
FIG. 18 shows two pivoted digit-tablets partially flipped; (#50) shows the digit 6 flipped almost through a 180 deg. turn.
Figure 19:
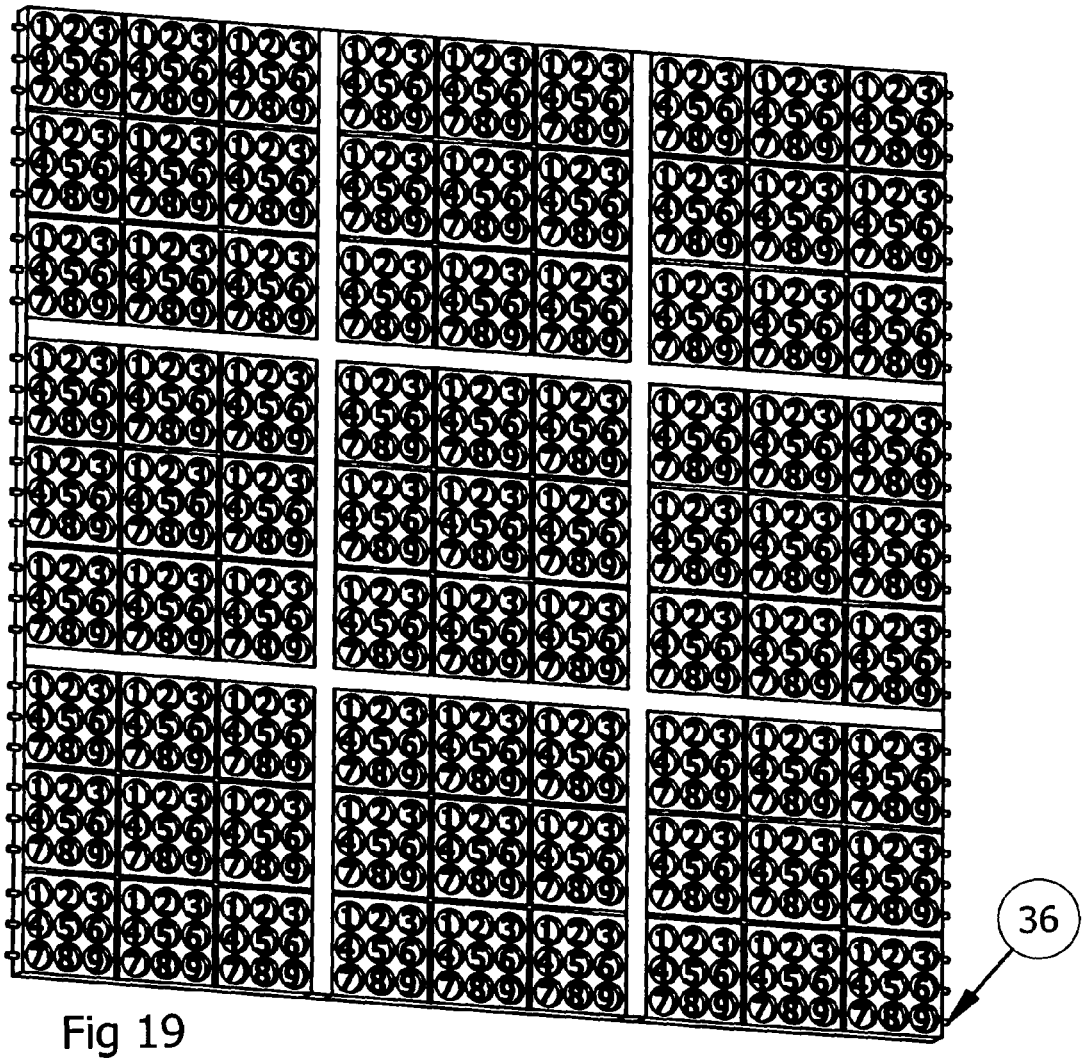
FIG. 19 shows a Sudoku board with round holes to house round, flippable digit-tablets on axle-wires.
Figure 20:
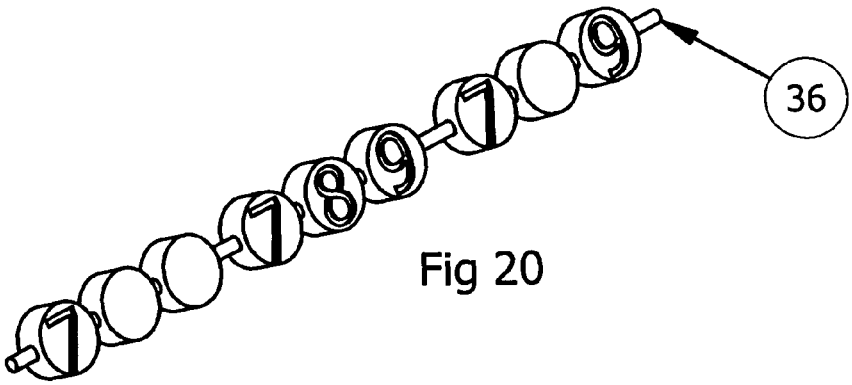
FIG. 20 shows three digit-tablets flipped to no-display status.

I claim:

1. A Sudoku puzzle solving apparatus comprising:

a substantially flat panel having, means of forming eighty-one areas of substantially equal size, wherein said areas are arranged in a square pattern of nine rows and nine columns, wherein each one of the rows has nine of said areas, and each one of said columns has nine of said areas, and wherein, each one of said areas comprises a means of forming nine substantially equal subareas, wherein each of the subareas of each one of said areas comprise a means of showing on them all the nine digits of one through nine in the manner of one digit in one subarea and further in a non-repeating manner of said showing of said digits in said area, and said apparatus further comprising;

means to set to no display status any of said digits from at display status, and means reset from said no display status of said digits back to at display status, each one of said areas is provided underneath said area with means of illuminating nine separate subareas individually, and with means of shutting off of said means of illuminating individually, whereby, said sudoku puzzle can be solved, by following the rules of sudoku and with the help of said apparatus in the following manner, when the space directly above each one of said subareas of each one of said areas is occupied by a single digit chosen from the single digits of one through nine in the manner that in any one subarea of said areas, any chosen digit appears only once, by setting all of said subareas initially illuminated to make each digit occupying the space above each one of said subareas visible, and followed by, shutting off of said means of illuminating in eight subareas, in each one of said areas that matches in position to said sudoku puzzle's corresponding initially given solution number's position on said sudoku puzzle, wherein said shutting off, results in the remainder of one illuminated subarea in each one of said areas containing eight subareas having shut off of said means of illuminating, and thereby results in the illumination of only one digit that matches with its corresponding initial solution given number in value on said sudoku puzzle, and further followed by, logically continuing the shutting off of the remainder of illuminated regions in the manner required for said sudoku puzzle's solutions by evaluating for non solution illuminated digits in every one of said subareas of said areas in said sudoku puzzle, until every one of said areas remains with only one digit illuminated.

2. A Sudoku puzzle solving apparatus comprising:

a substantially flat panel having, means of forming eighty-one areas of substantially equal size, wherein said areas are arranged in a square pattern of nine rows and nine columns, wherein each one of the rows has nine of said areas, and each one of said columns has nine of said areas, and wherein, each one of said areas comprises a means of forming nine substantially equal subareas, wherein each of the subareas of each one of said areas comprise a means of showing on them all the nine digits of one through nine in the manner of one digit in one subarea and further in a non-repeating manner of said showing of said digits in said area, and said apparatus further comprising;

means to set to no display status any of said digits from at display status, and means reset from said no display status of said digits back to at display status, each one of said areas is constructed in the manner of a honeycomb of nine open subareas, wherein each one of said open subareas is occupied by a flippable pivoted pad, wherein said pivoted pad may be positioned to view one side of said pivoted pad, and said pivoted pad may be flipped to view the side to the rear of said one side, whereby, said sudoku puzzle can be solved, by following the rules of sudoku and with the help of said apparatus in the following manner, when one of said sides of each pad in each one of said subareas of each one of said areas is occupied by a single digit chosen from the single digits of one through nine in the manner that in any one subarea of said areas, any chosen digit appears only once, by positioning initially the side of each one of said pads containing a digit visible, and followed by, flipping of eight pads in the manner to show the side with no digit, in each one of said areas that matches in position to said sudoku puzzle's corresponding initially given solution number's position on said sudoku puzzle, wherein said flipping of eight pads, results in the remainder of one non flipped pad in each one of said areas containing eight flipped pads, and thereby results in the visibility of only one digit that matches with its corresponding initial solution given number in value on said sudoku puzzle, and further followed by, logically continuing the flipping of the remainder of pads having the visibility of their digits in the manner required for said sudoku puzzle's solutions by evaluating for non solution visible digits in every one of said subareas of said areas in said sudoku puzzle, until every one of said areas remains with only one digit visible.

* * * * *